US006527200B1

(12) United States Patent
Huang

(10) Patent No.: US 6,527,200 B1
(45) Date of Patent: Mar. 4, 2003

(54) SPRAY HEAD OF A SPRAY PAINT GUN

(76) Inventor: Tiao-Hsiang Huang, No. 190, Chung Chen St., Shin Chuang City, Taipei Hsien (TW)

( * ) Notice: Subject to any disclaimer, the term of this patent is extended or adjusted under 35 U.S.C. 154(b) by 0 days.

(21) Appl. No.: 10/020,235

(22) Filed: Dec. 18, 2001

(51) Int. Cl.[7] ..... B05B 1/28
(52) U.S. Cl. ..... 239/296; 239/290; 239/292
(58) Field of Search ..... 239/296, 290, 239/291, 292, 298

(56) References Cited

U.S. PATENT DOCUMENTS 2,139,133 A * 12/1938 Paasche ..... 239/296
4,392,617 A * 7/1983 Bakos et al. ..... 239/290
5,779,153 A * 7/1998 Wu ..... 239/296
6,471,144 B1 * 10/2002 Huang ..... 239/296

* cited by examiner

*Primary Examiner*—Michael Mar
*Assistant Examiner*—Dinh Q. Nguyen
(74) *Attorney, Agent, or Firm*—Rosenberg, Klein & Lee

(57) ABSTRACT

A head for a spray gun with exchangeable nozzles having a gasket provided in the front of the spray gun and engaged to a threaded coupler; inner and outer recesses being provided in both of the spray gun and a threaded coupler; slots being provided in the gasket; one air outlet being each provided in the inner and the outer recess; plural air outlets being provided in the outer recess of the coupler to connect through a ditch space segregated by a flange in the front of the coupler; a circular ditch having its outer wall as a push-pull plane being formed in the front of the coupler; ventilation holes in the inner recess being drilled to connect the ditch; a circular segment formed at the outer surface of the nozzle engaged to the front of the coupler; and an indention in the spray head being provided with a push-pull surface abutted to the push-pull plane of the ditch to shorten and simplify interchangeable nozzles.

1 Claim, 5 Drawing Sheets

SPRAY HEAD OF A SPRAY PAINT GUN

BACKGROUND OF THE INVENTION (a) Field of the Invention

The present invention relates to a spray head for a spray paint gun, and more particularly, to one that is adaptable to a shorter and less sophisticate nozzle, thus can be equipped with more derived interchangeable nozzles.

(b) Description of the Prior Art

To ensure stabilized and well distributed air flow, a buffer structure is usually provided between the air outlet at the tip of the spray head and the nozzle and air outlet of the nozzle to any comparatively precision spray paint gun. As illustrated in FIGS. 3, 4 and 5 of the accompanying drawings, a spray head structure of the prior art to lead out consistent air flow to evenly deliver the coating is essentially comprised of an airtight diverting ring (B), a threaded coupler (C), a nozzle (D), a spray head (E) and a nut (F) connected in sequence to the body of the spray gun (A). Wherein, a passage to direct and deliver the coating is formed at the center of the front of the spray gun (A). A screw hole (A1) is formed at the front of the passage and a regulation shaft (G) extends out of the passage. The screw hole (A1) engaged to threaded coupler (C). Two segmental recesses (A2, A3) and a hole (A4) are provided on the surface of outer ring of the screw hole (A1). Two air ducts (A5, A6) are respectively provided in the recesses (A2, A3). Two air ports (B1, B2) and a stub (B3) to match said recesses (A2, A3) and said hole (A4) facing the front end of the spray gun (A) are provided in the diverting ring (B). Two slots (B4, B5) are respectively provided in each of said two air ports (B1, B2).

The diverting ring (B) is abutted to the front end of the spray gun (A) by having inserting the stub (B3) into the hole (A4), wherein, said two air ports (B1, B2) are merely adhered to said recesses (A2, A3) to define two air diverting ports for the air flow passing through said slots (B4, B5). A hollow worm gear (C1) is formed in the rear of the threaded coupler (C) to receive insertion by the diverting ring (B) so that the rear of the threaded coupler (C) is adhered to the diverting ring (B) and engaged to the screw hole (A1) in the front of the spray gun (A). An inner and an outer recesses (C2, C3) are respectively formed in the rear surface of the threaded coupler (C). Plural ventilation pores (C4) provided in the inner recess (C2) are connected through a tapered circular slot (C6) in the front of the threaded coupler (C); and plural ventilation pores (C5), directly connected through the front end of the threaded coupler (C). An inner screw hole (C7) formed in the front center of the worm gear (C1) is engaged to another worm gear (D1) formed in the rear of the nozzle (D). A circular channel (D2) is formed around the worm gear (D1) and plural through holes (D3) are provided in the channel (D2) to connect to the front end of the nozzle (D). Those through holes (D3) are arranged surrounding a nose (D4). The spray head (E) is engaged to the nut (F) and is secured to the front of the spray gun (A) and coupled by the front of the nozzle (D) by means of the outer threads (C8) on the threaded coupler (C) that the nut (F) is engaged to the threaded coupler (C). A concave (E1) and a circular indention (E2) inside the nozzle (E) define a graded space. Air ducts (E3) provided on the concave (E1) communicate two air outlet bases (E4) in symmetric provided externally to the spray head (E). A spray hole (E5) is provided in the center of the circular indention (E2) to allow the insertion by a play of the nose (D4) of the nozzle (D). Disturbance holes (E6) are provided surrounding the spray hole (E5) and a tapered surface (D5) formed to the front by having the circular indention (E2) to hold against the front of the nozzle (D).

In practice, high pressure air fed to the spray head comprised of those members as described above passes through those two segmental recesses (A2, A3) in the front surface of the body of the spray gun (A), leaves from those two air ducts (A5, A6), and enters into said two air ports abutted to the diverting ring (B). Wherein, the high pressure air is buffered for the first time and diverted respectively through said two slots (B4, B5) respectively in the inner and out rings of the diverting ring (B) to the inner and outer recesses of the threaded coupler (C) adhered to the rear of the diverting ring (B) [air flow routes respectively illustrated in FIGS. 4 and 5]. The high pressure air is buffered therein for the second time. The high pressure air from the inner recess (C2) flows through those ventilation pores (C4) to those air ports defined by a tapered circular slot (C6) in the front of the threaded coupler (C) adhered to the circular channel (D2) of the worm gear (D1), then the through holes (D3) to the front end of the nozzle (D), and finally into the indention (E2) of the spray head (E). On the other hand, the air flow in the outer recess (C3) passes through the air outlet (C5) to the front end and into the peripheral concave (E1) to the spray head (E). The air in the circular indention (E2) is jetted from those disturbance holes (E6) and the play formed by the insertion of the nozzle nose (D4) into the spray hole (E5) while the air in the concave is (E1) is delivered by those air outlet bases (E4) provided externally to the air ducts (E3) so to disturb both the air flow and the coating jetted from the nozzle (D) for delivering atomized, evenly distributed wide coverage of coating.

However, in the spray head structure of the prior art, the nozzle (D) used relates to a longer body in terms of the configuration of the entire assembly. The matching spray head (E) is also required to have deeper indention (E2) and longer body sufficient to accommodate the insertion of the fully length of the tapered surface (D5) to hold against the circumference of the indention (E2), thus to define the final air port for air jet. As the nozzle is made of stainless steel material and drill work is required for the circular channel (D2) in the rear of the nozzle (D) to connect all way to those multiple through holes (D3) in very small diameter, and the nozzle (D) is comparatively longer, it requires longer and deeper drilling. It makes the drilling difficult to process resulting in frequent drilling error, thus higher percentage of defective products, and increased production cost. Furthermore, the circular channel (D2), those through holes and extended tapered surface of the nozzle (D) not only requires a complicate structure and larger size for the nozzle (D), but also restricts the possibility of interchangeability among different types of the nozzle (D).

SUMMARY OF THE INVENTION

The primary purpose of the present invention is to provide an improved structure for a head of a spray paint gun with air pressure stabilizing effects that is adaptable to a shorter and less complicate nozzle, thus to more types of derived nozzles. To achieve the purpose, a threaded coupler is engaged to the air outlet end section of the spray head and a gasket is inserted between the end plane and the threaded coupler. Inner and outer recesses are formed on both abutted surfaces of the end plane and the threaded coupler. Multiple slots arranged in proper distance among one another are formed in the gasket corresponding to those inner and outer recesses. One air outlet duct is each provided in those inner and outer recesses in the spray gun. Air outlets provided in the outer recess of the threaded coupler is connected to a ditch segregated by a flange. Another ditch is formed in the front of the threaded coupler relatively to a hollow worm gear and a push-pull plane is formed to the outer wall of the ditch. Air ventilation holes in the inner recess are drilled all way to the ditch. The nozzle is engaged to an inner screw hole at the front end of the hollow worm gear in the threaded coupler. A circular segment extends from the outer circumference of the nozzle into an inner edge of its corresponding circular ditch. A push-pull surface is formed surrounding the edge of the circular indention in the nozzle to accommodate insertion of the nozzle for the push-pull surface is abutted to the push-pull plane in the circular ditch of the threaded coupler. As a result, all the ports in the air flow passage are provided in the threaded coupler to provide a shorter structure for the nozzle.

DETAILED DESCRIPTION OF THE PREFERRED EMBODIMENTS

Figure 1:
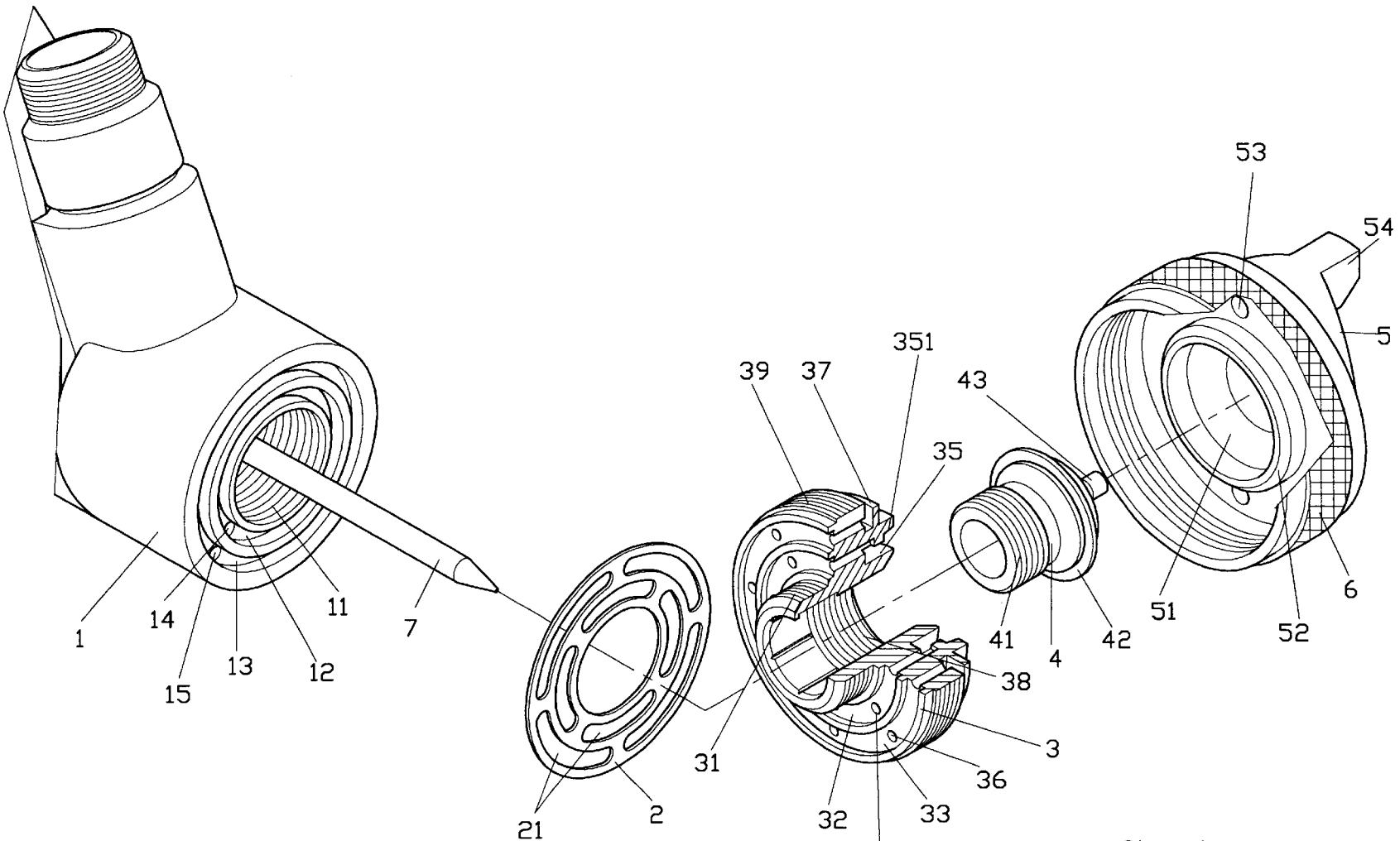
FIG. 1 shows an exploded view of a preferred embodiment of the present invention.
Figure 2:
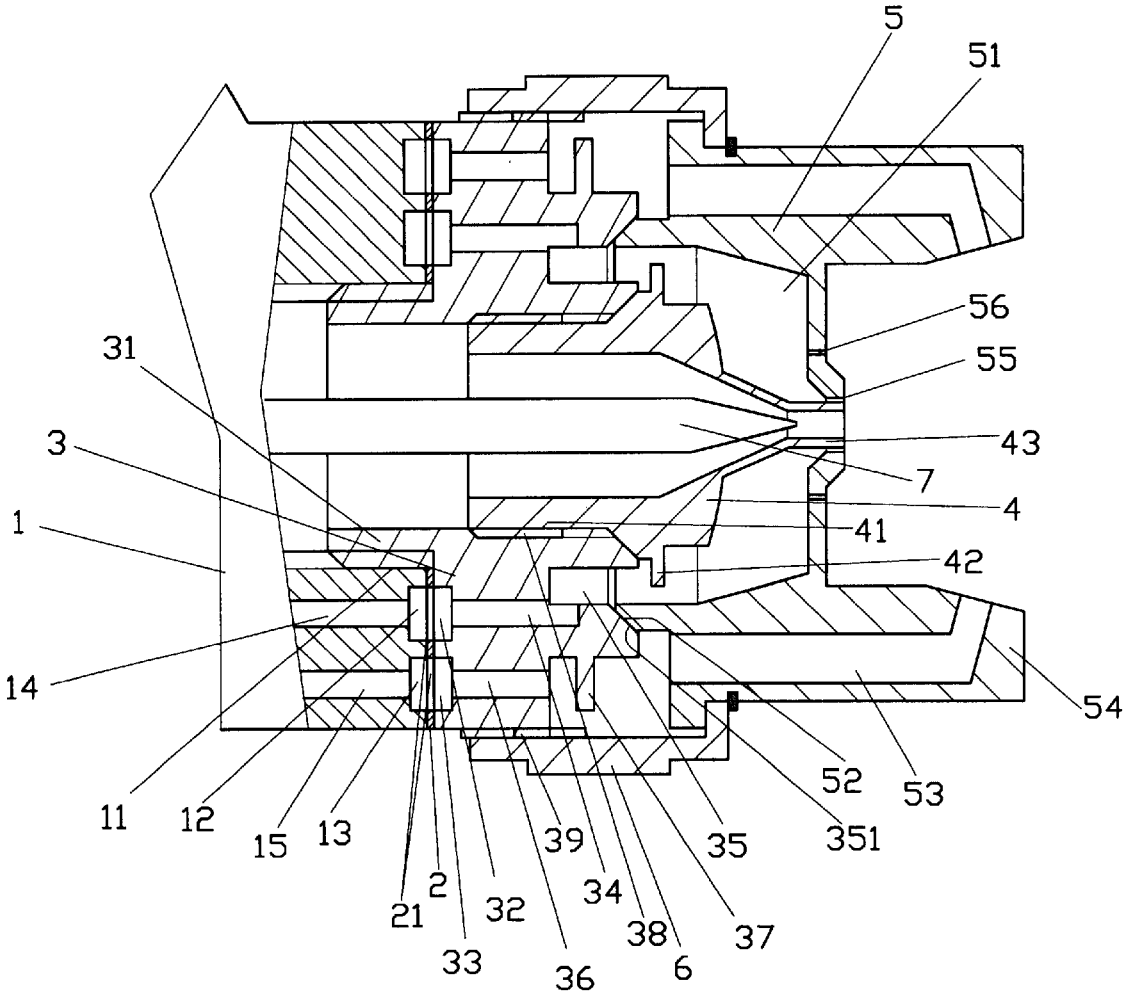
FIG. 2 is a sectional view of an assembly of the preferred embodiment of the present invention.
Figure 3:
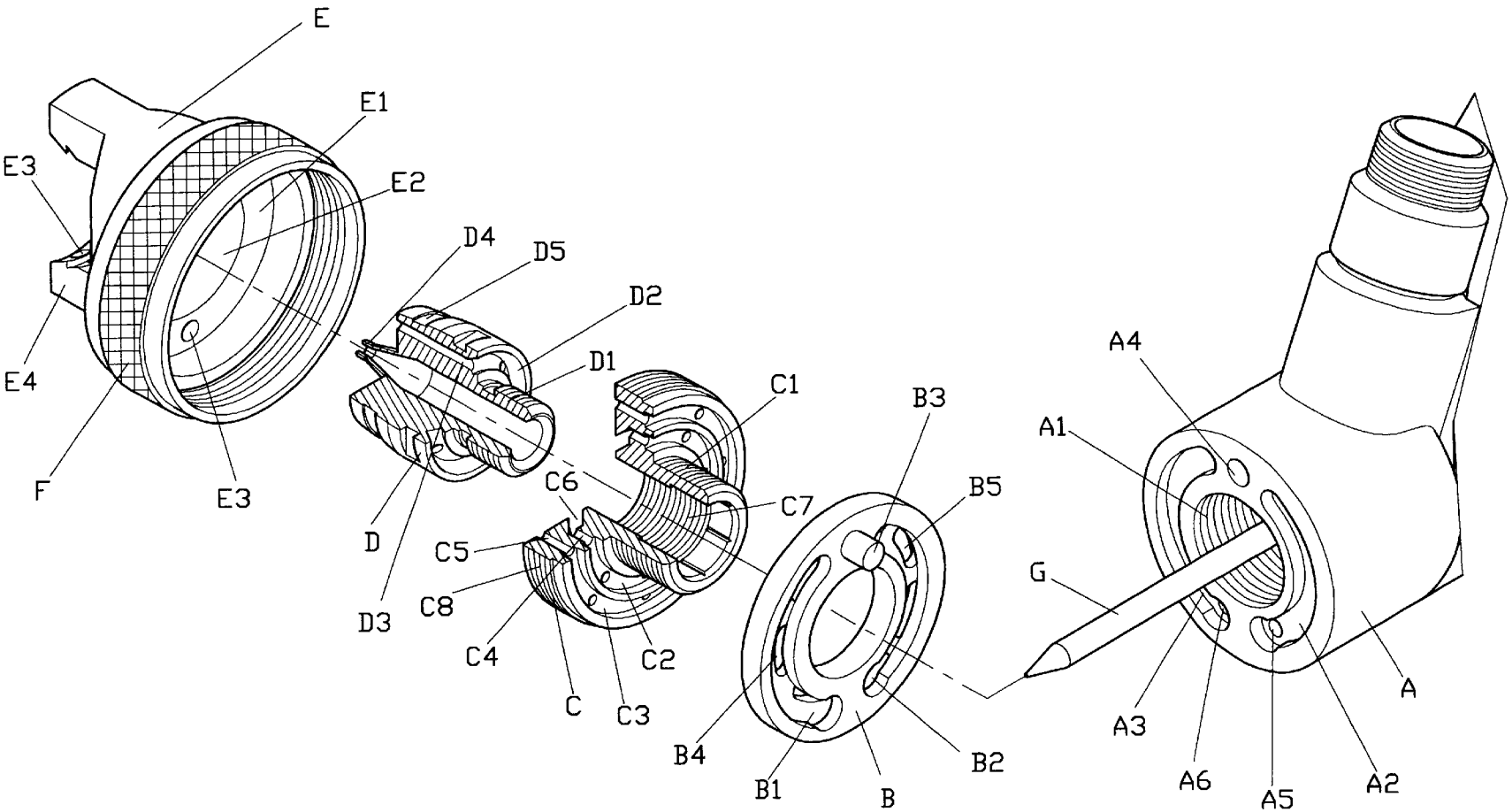
FIG. 3 (PRIOR ART)
FIG. 3 is an exploded view of a prior art.
Figure 4:
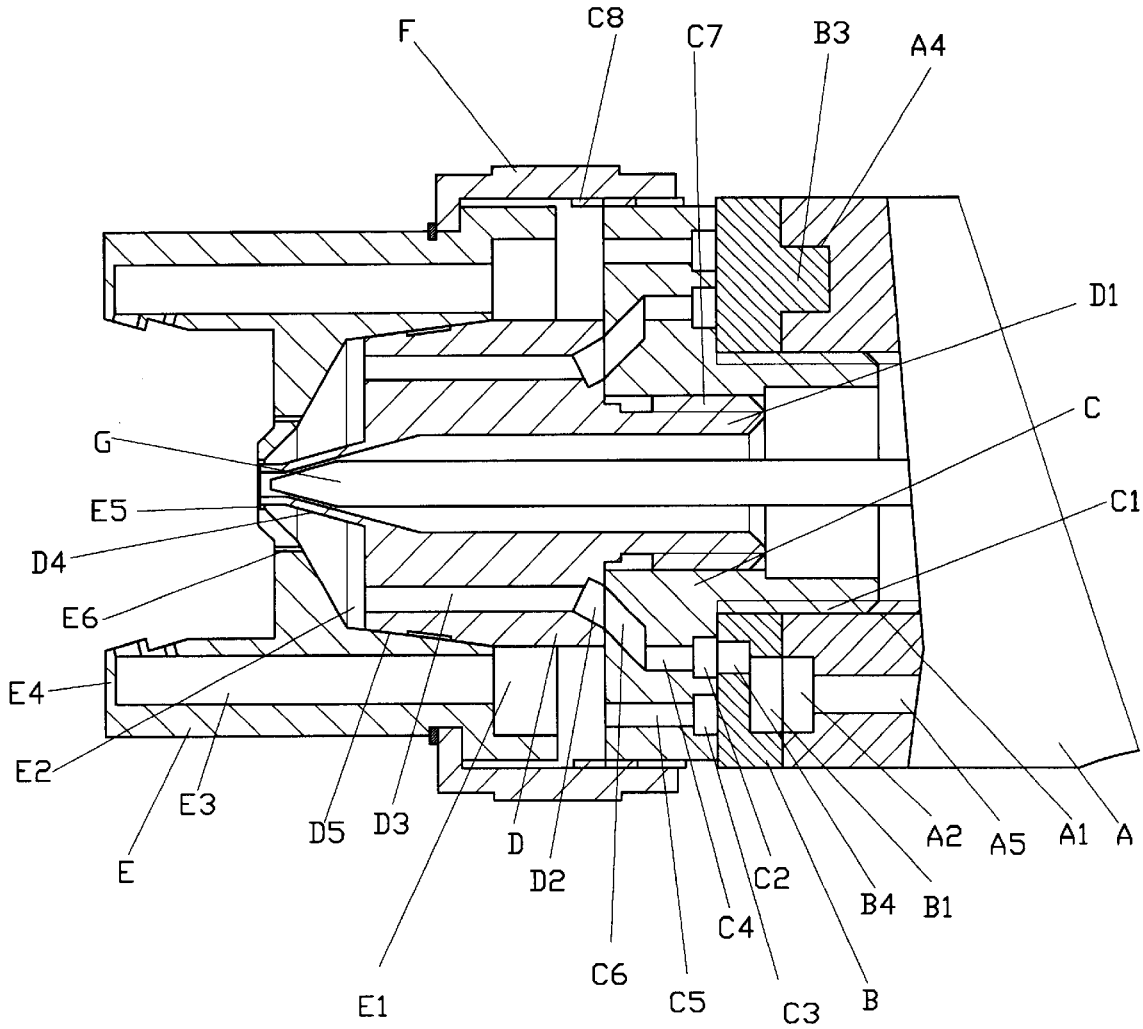
FIG. 4 (PRIOR ART)
FIG. 4 is a sectional view of an assembly of the prior art.
Figure 5:
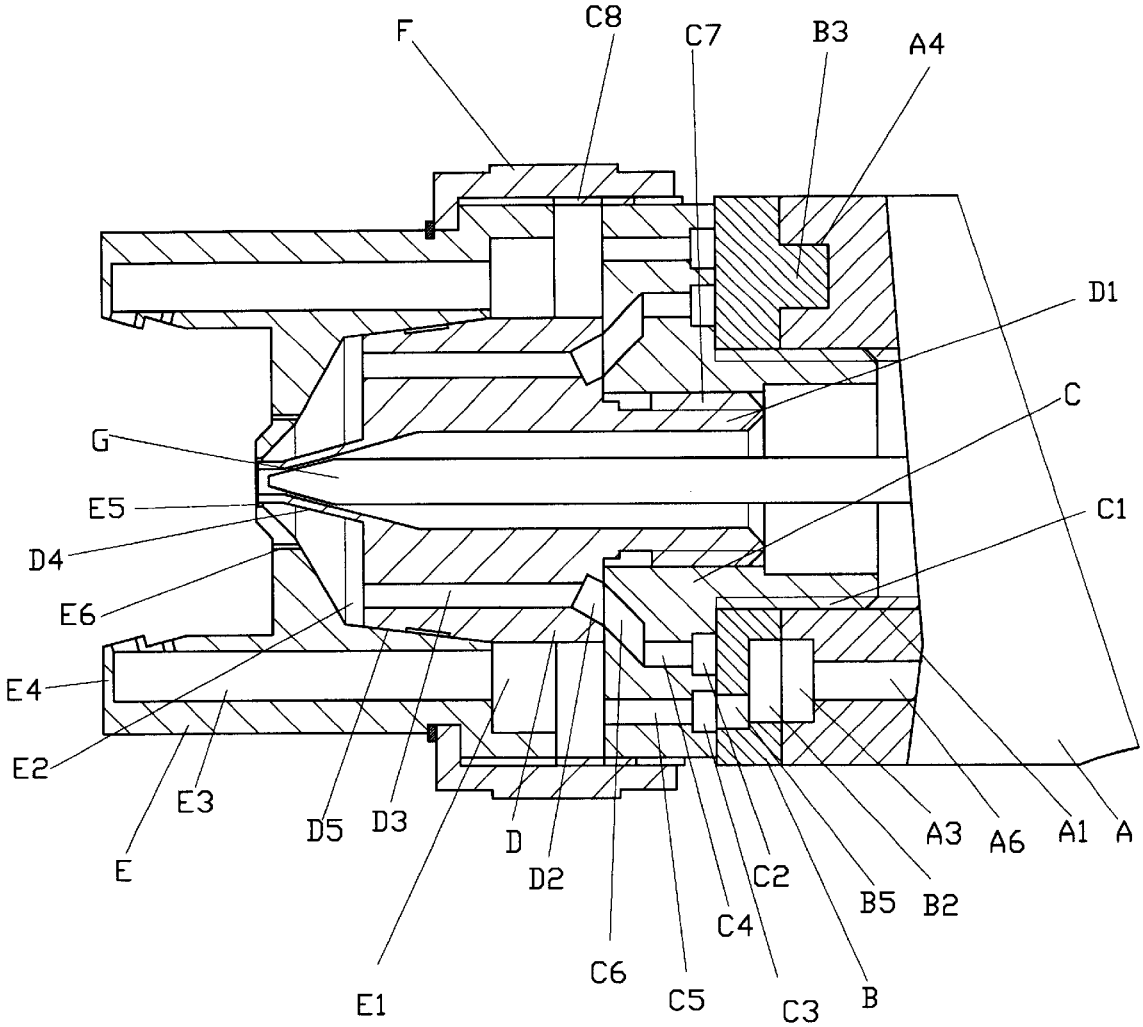
FIG. 5 (PRIOR ART)
FIG. 5 is another sectional view of the assembly of the prior art.

Referring to FIGS. 1 and 2, a pressure stabilization head for a spray paint gun of the present invention comprises a gasket (2), a threaded coupler (3), a nozzle (4), a spray head (5) and a nut (6) connected in sequence to the front of a spray gun (1). Wherein, a screw hole (11) is formed in the front section of a passage wherein a regulation shaft (7) having a sharp nose is protruding from the center of the front of the spray gun (1). The screw hole (11) is engaged to the threaded coupler (3). An inner and an outer recesses (12, 13) each respectively containing an air outlet (14, 15) are provided in the front of the spray gun (1).

Plural slots (21) corresponding to the inner and outer recesses (12, 13) are provided in the gasket (2) and arranged in proper distance among one another.

A hollow worm gear (31) formed in the rear of the threaded coupler (3) is inserted through the gasket (2) for the rear side to tightly adhered to the screw hole (11) of the spray gun (1). An inner and an outer recesses (32, 33) to adhere to the slots (21) in the gasket (2) and the inner and outer recesses (12, 13) of the spray gun (1) are provided in the rear of threaded coupler (3). Plural ventilation holes (34) are provided in the inner recess (32) of the threaded coupler (3). A ditch (35) is formed surrounding in the front of the threaded coupler (3) relatively to the hollow worm gear (31). A push-pull plane (351) is formed on the outer wall of the ditch (35). The ventilation holes (34) in the inner recess (32) are drilled to connect to the ditch (35). Plural air outlets (36) provided in the outer recess (33) of the threaded coupler (3) penetrate into a space defined by s flange (37) at the front of the threaded coupler (3). An inner screw hole (38) is formed in the front of the threaded coupler (3) to be engaged to the nozzle (4). Outer threads (39) formed on the outer surface of the threaded coupler (3) are used to engage the threaded coupler (3) to the nut (6).

Another worm gear (41) formed in the rear of the nozzle (4) is used to engage the inner screw hole (38) in the front of the threaded coupler (3). A circular segment (42) formed on the outer surface of the nozzle (4) extends into the inner edge of the circular ditch (35) of the threaded coupler (3) and a nose (43) is formed at the front of the nozzle (4).

The spray head (5) is engaged to the spray gun (1) by means of the nut (6), which is engaged to the outer threads (38) of the threaded coupler (3) so that the spray head (5) is secured to the front of the spray gun (1), engaged to the front of the nozzle (4) and hold against the threaded coupler (3). A circular indention (51) is formed inside the spray head (5). The edge of the indention (51) is formed with a push-pull surface (52) for the push-pull circular segment (52) to be abutted to the push-pull plane (351) of the circular ditch (35) of the threaded coupler (3).

Air ducts (53) connected to two air outlet bases (54) in symmetric provided outside the spray head (5) are provided in an outer ring around the push-pull circular segment (52). A spray hole (55) is formed in the center of the indention (51) to allow insertion by the nozzle nose (43) and plural holes (56) for causing disturbance are provided surrounding the spray hole (55).

As illustrated in FIG. 2, a high pressure gas supplied to the spray gun (1) passes through the inner and the outer recesses (12, 13) of the front of the spray gun (1) and respectively leaves the air outlets (14, 15) to be buffered for the first time by the space segregated due to the adherence by the gasket (2) before entering through the slots (21) of the gasket (2) into those inner and outer recesses (32, 33) of the threaded coupler (3) to be buffered for the second time. The buffered high pressure air in the inner recess (32) flows through the air ventilation holes (34) to the circular ditch (35) in front of the threaded coupler (3). A port having a larger space and smaller outlet is formed by the circular ditch (35) with the circular segment (42) of the nozzle (4) extending into the inner edge of the circular ditch (35). The outlet of the air port relates to a slanted outlet by compromising a push-pull plane (351) of the circular ditch (35) for the air to be buffered for the third time before entering a closed passage formed by the spray head (5) abutted to the push-pull plane (351) of the circular ditch (35) by means of a push-pull circular surface (52), thus to be directed into the circular indention (51) in the spray head (5). Meanwhile, the air in the outer recess (33) of the threaded coupler (3) passes from those air outlets (36) to the space in the ditch (35) at the front and is retained by the flange (37) for pressure reduction. The air with reduced pressure flows from a play of the circumference of the flange (37) into a space defined by the outer place to the peripheral of the flange (37). The air in the indention (51) is jetted from the play formed when the nozzle nose (43) is inserted, as well as from those disturbance holes (56) of the spray head (6). The air in the space defined by the outer circumference of the push-pull surface (52) is delivered through the air ducts (53) by those air outlet bases (54) provided externally to the spray head (5) to jointly create disturbance upon and atomize both of the coating and air jetted from the nozzle (4) to facilitate consistent and wide coverage spray.

As taught by the preferred embodiment disclosed above, the improved structure of a head for a spray gun of the present invention not only effectively reduces the length of the spray head (5) by having the pressure stabilization structure and most of the air outlets respectively provided in the front of the spray gun (1) and the threaded coupler (3); but also reduces the complexity of unit members by replacing an airtight air diverting ring of the prior art with a gasket (2). The most significant feature of the present invention is that the nozzle made of stainless still can be shortened and saved from drilling job thereon to avoid process difficulties confronted in precision drill over a comparatively longer range and problem of higher defective products due to drill error, meaning upgraded manufacturing benefits and cost reduction. The present invention by offering a simplified and shorten structure for the nozzle eliminates the necessity of providing connecting air duct to allow interchangeability among nozzles of diversified designs for an even wider application range of the spray gun.

To cope with the interchangeability of nozzles, the improved structure of a spray head of the present invention effectively promote the application benefits of a spray gun is innovative.

I claim:

1. A structure of a spray gun head with interchangeable nozzle comprising a gasket, a threaded coupler, a nozzle, a spray head and a nut connected in sequence to a front of a spray gun; wherein, a screw hole to engage to the treaded coupler being formed in a front of a passage for a regulating point shaft extending from a center of an air outlet of the spray head; the gasket being inserted between the spray gun and the threaded coupler; an inner and an outer recesses being formed on a front surface of the spray gun; plural slots arranged in proper distance among one another being provided in the gasket to correspond to inner and outer recesses of the spray gun; an air outlet being each provided in the inner and outer recesses of the spray gun; plural air outlets connecting through a space segregated by a flange in a front of the threaded coupler; ventilation holes being separately drilled to the front of the threaded coupler; an inner screw hole being provided in the front section of the threaded coupler to be engaged to another worm gear disposed in a rear of the nozzle; outer threads being provided on an outer surface of the threaded coupler for the nut to be engaged to the spray head; a circular indention formed inside the spray head being engaged to a front of a nozzle and secured by holding against the threaded coupler; air ducts being provided in an outer ring of the spray head connected to two air outlet bases externally provided to the spray head; a spray hole being formed in a center of a circular indention; and plural holes for disturbance being provided around the spray hole; characterized by that:

a circular ditch being formed at the front of the threaded coupler in relation to a hollow worm gear at a center; a push-pull plane being formed on an outer wall of the ditch; the ventilation holes in the inner recess being drilled through the ditch; a circular segment formed on an outer surface of the nozzle engaged to the front of the threaded coupler being extended into an inner edge inside the corresponding ditch; a push-pull surface being formed on an edge of the circular indention; the push-pull surface being abutted to the push-pull plane of the circular ditch of the threaded coupler; and the front of the nozzle with the circular segment being extended into the circular indention.

* * * * *